US006698050B1

(12) United States Patent
Frye

(10) Patent No.: US 6,698,050 B1
(45) Date of Patent: Mar. 2, 2004

(54) SHOE AND LAST

(76) Inventor: Nancy C. Frye, 3526 Rockcrest Dr., Garland, TX (US) 75044

( * ) Notice: Subject to any disclaimer, the term of this patent is extended or adjusted under 35 U.S.C. 154(b) by 0 days.

(21) Appl. No.: 09/688,308

(22) Filed: Oct. 13, 2000

Related U.S. Application Data

(63) Continuation-in-part of application No. 08/698,470, filed on Aug. 15, 1996, now Pat. No. 6,131,315, which is a continuation of application No. 08/380,814, filed on Jan. 30, 1995, now abandoned.

(51) Int. Cl.[7] ..... A43D 3/00
(52) U.S. Cl. ..... 12/133 R; 12/133 B; 12/128 R
(58) Field of Search ..... 36/88, 93; 12/128 R, 12/133 R, 135 R, 133 B, 128 E, 142 N, 142 RS

(56) References Cited

U.S. PATENT DOCUMENTS

| | | | | |
|---|---|---|---|---|
| 245,306 | A | * | 8/1881 | Miller |
| 380,395 | A | | 4/1888 | Kramer |
| 681,959 | A | | 9/1901 | Fenno |
| 754,577 | A | | 3/1904 | Laub |
| 806,622 | A | | 12/1905 | Baker et al. |
| 843,199 | A | | 2/1907 | Doyle |
| 958,277 | A | | 5/1910 | Phinny |
| 974,941 | A | | 11/1910 | Wilkerson |
| 1,094,739 | A | * | 4/1914 | Mountain |
| 1,140,879 | A | | 5/1915 | Custar |
| 1,232,114 | A | | 7/1917 | Sorley |
| 1,851,778 | A | | 3/1932 | Skillen |
| 1,938,617 | A | | 12/1933 | Augusta |
| 1,964,705 | A | | 6/1934 | Pellkofer |
| 2,054,188 | A | | 9/1936 | Bates |
| 2,212,613 | A | | 8/1940 | Messina |
| 2,379,000 | A | | 6/1945 | Gould |
| 2,434,770 | A | | 1/1948 | Lutey |
| 2,518,649 | A | | 8/1950 | Tydings et al. |
| 2,519,613 | A | | 8/1950 | Urban |
| 2,526,205 | A | | 10/1950 | Doerschler |
| 2,555,590 | A | | 6/1951 | Johnson |
| 2,599,970 | A | | 6/1952 | Barrons |
| 2,720,714 | A | | 10/1955 | Krohn et al. |
| 2,722,756 | A | | 11/1955 | Ecclesine |
| 2,769,252 | A | | 11/1956 | Monier |

(List continued on next page.)

FOREIGN PATENT DOCUMENTS

| | | |
|---|---|---|
| DE | 181796 | 10/1905 |
| DE | 19854979 A1 | 5/2000 |
| EP | 0083449 | 12/1981 |
| FR | 2 769 184 | 4/1999 |
| JP | 5-277001 | 10/1993 |

OTHER PUBLICATIONS

Roots "Nature" Shoes brochure, 2 pages.
"The Fate of the Earth Shoe" Time Magazine Article, May 1, 1995, 1 page.
PCT Search Report, dated May 7, 2002, 10 pages.
PCT Search Report, PCT/US01/32048, dated Mar. 6, 2002, 5 pages.

*Primary Examiner*—M. D. Patterson
(74) *Attorney, Agent, or Firm*—Baker Botts L.L.P.

(57) ABSTRACT

A footwear exercising device for use by a wearer in improving various aspects of the wearer's physical condition, health and overall appearance. The footwear exercising device of the present invention includes a reverse wedge for wear below the sole of a wearer's foot, and may be worn with a wide variety of fashion. Prolonged use of the device of the present invention has been shown to improve the tone of the muscle groups of a wearer's body which have to do with the wearer's posture. Prolonged use of the instant invention has also been shown to improve the blood circulation in a wearer's legs and to strengthen significantly the muscles supporting a wearer's knees. The design of the device is such that prolonged wear of the invention is neither strenuous nor taxing.

3 Claims, 4 Drawing Sheets

U.S. PATENT DOCUMENTS 2,805,432 A * 9/1957 Riggs
2,814,133 A 11/1957 Herbst
2,847,769 A 8/1958 Schlesinger
2,855,704 A 10/1958 Schlesinger
D185,289 S 5/1959 Kadlec
2,896,229 A 7/1959 Doherty
3,061,951 A 11/1962 Barron
3,204,348 A 9/1965 Latson
3,300,880 A 1/1967 Campagna
3,305,947 A 2/1967 Kalsoy
3,472,508 A 10/1969 Baker et al.
3,613,272 A 10/1971 Fukuoka
3,693,269 A 9/1972 Guarrera
3,739,500 A 6/1973 Cox
3,812,603 A 5/1974 Goodman
3,820,254 A 6/1974 Kopacsi
3,964,181 A * 6/1976 Holcombe, Jr.
D245,734 S 9/1977 Jacobs
4,155,180 A 5/1979 Phillips
4,217,704 A 8/1980 Whitaker
4,265,033 A 5/1981 Pols
4,370,818 A 2/1983 Simoglou
4,494,266 A * 1/1985 Bartneck ..... 12/142 RS
4,526,365 A 7/1985 Ziegelbaum
4,530,173 A 7/1985 Jesinsky, Jr.
4,546,557 A 10/1985 Barouk et al.
4,573,678 A 3/1986 Lamb et al.
4,589,216 A 5/1986 Fuscone
4,681,114 A 7/1987 Lodispoto
4,686,993 A 8/1987 Grumbine
4,726,127 A 2/1988 Barouk
4,733,483 A 3/1988 Lin
4,738,262 A 4/1988 Zebrack
4,934,073 A 6/1990 Robinson
4,989,349 A 2/1991 Ellis, III
5,075,984 A 12/1991 Shiew
5,231,723 A 8/1993 White et al.
5,317,819 A 6/1994 Ellis, III
5,339,252 A 8/1994 White et al.
5,339,542 A 8/1994 Kim
5,507,106 A 4/1996 Fox
5,592,757 A 1/1997 Jackinsky
5,661,864 A 9/1997 Valiant et al.
5,692,318 A 12/1997 Aliano, Jr.
5,752,330 A * 5/1998 Snabb

* cited by examiner

SHOE AND LAST

CROSS REFERENCE TO RELATED APPLICATIONS

This application is a continuation-in-part of U.S. application Ser. No. 08/698,470 filed Aug. 15, 1996, now U.S. Pat. No. 6,131,315, which is a continuation of U.S. application Ser. No. 08/380,814 filed Jan. 30, 1995, abandoned.

TECHNICAL FIELD OF THE INVENTION

The present invention relates in general to footwear and more particularly to an improved shoe and last.

BACKGROUND OF THE INVENTION

The present invention relates to exercise devices, and more particularly concerns exercise devices for wear with, or as part of, a shoe.

Many footwear exercising devices have been proposed in the prior art for exercising the leg and back muscles. Examples of such devices can be found in the following U.S. Letters Patent: U.S. Pat. No. 2,769,252 by A. E. Monier; U.S. Pat. No. 3,472,508 by Baker et al.; U.S. Pat. No. 3,926,181 by Holcombe, Jr.; U.S. Pat. No. 4,573,678 by Lamb et al.; U.S. Pat. No. 4,681,114 by Lodispoto; and U.S. Pat. No. 4,934,073 by Robinson. While these devices may be suitable for a particular purpose to which they address, it will be apparent to those skilled in the art that said devices would not be as suitable for the purposes of the present invention. Indeed, the devices of Monier, Baker et al. and Lamb et al. are all designed for purely therapeutic purposes, making it very difficult to wear such exercise devices throughout the activity of a normal day. On the other hand, the devices of Holcombe, Jr., Lodispoto and Robinson are designed for more prolonged wear. However, neither of the Lodispoto, Holcombe, Jr., or Robinson designs is able to be worn throughout the activities of a normal day with the extraordinary amount of comfort and lack of fatigue as is available through the present invention and still accomplish all the exercise purposes of the present invention.

The Lodispoto design comprises a solid wooden sole attached to a single band sandal-type shoe upper. As well as being inflexible, the lower surface of the wooden sole of this device is shaped with a long incline curving upward from a forward standing contact point with a floor surface just rearward of the ball of a wearer's foot, to the forward most point on the sole. Such a forward incline by itself would cause a significantly greater amount of angular rotation of the plane of a wearer's foot about the axis of the wearer's ankle when walking, than that which is required in use of the instant invention. Yet, an even greater amount of such rotation is required via the sandal-type strap arrangement of the Lodispoto design, producing a flip-flop type movement between the rear portion of the device and a wearer's heel when walking. Although sandal-type arrangements may be used as part of the present invention, the significantly flat nature of a lower surface of the instant invention allows for wearer's thereof to accomplish the purposes of the invention with significantly less angular rotation and attendant exhaustion than that which is required in using the Lodispoto device.

The Holcombe, Jr., device includes the same forward inclining plane problem as the Lodispoto device, although to a lesser extent, due to the use of a shorter forward plane, a complete shoe upper and more flexible sole materials. The Holcombe, Jr., design is further severely limited in its application, since it is made as a purely exercise device without the intended purpose of being worn in more fashionable settings as a wearer of the device may wish to attend throughout the course of a normal day, were such continued wear feasible. The design of Holcombe, Jr., is an attempt to overcome the fashion difficulties associated with both the Lodispoto and the Robinson designs, by providing a forwardly inclining plane immediately below the sole of a wearer's foot inside footwear of the device. Although the Holcombe, Jr., design is more fashionable than the other cited prior art, it is still severely limited in its ability to provide the great amount of fashion variety which is available with exercising footwear using the instant invention. The Holcombe, Jr., is further severely limited in its ability to provide a substantially hidden inclined plane of such an angle between upper and lower surfaces of the inclined plane as that which is available with the instant invention.

Although these and other such devices now in the prior art have attempted to address similar exercise needs as that addressed by the instant invention, they have failed to address both the need for such devices to be worn for extremely long periods of time throughout the course of a wearer's day, and the need for such devices to accommodate an extremely wide variety of fashion, such that a wearer does not hesitate to wear the exercising device throughout all the activities of the wearer's day. As well, such devices have failed to achieve the replaceable-cost efficiencies available to users of the present invention.

SUMMARY OF THE INVENTION

In view of the foregoing disadvantages inherent in the known types of devices now present in the art, the invention disclosed herein provides an improved exercising device for wear below the sole of a wearer's foot and including a forwardly inclined "reverse wedge," and means for adjoining the reverse wedge to the wearer's foot. Upon a closer review of the more detailed description herein, those skilled in the art will recognize that the concepts of the present invention easily overcome both the problems described above and other problems which have been heretofore commonly associated with footwear exercising devices of the prior art. As such, the general purpose of the present invention is to provide a new and improved footwear exercising device which has all the advantages of the prior art and none of the disadvantages.

It is an additional object of the present invention to provide a new and improved footwear exercising device for improving the condition and tone of the following muscle groups: gluteus maximus, gluteus medius, gluteus minimus, tensor fasciae latae, pyriformis, gemellus superior, obturator intemis quadratus femoris, psoas major, illiacus, rectus femoris, vastus medialis, vastus intermedius, vastus lateralis, biceps femoris, semitendinosus, semimembranosus, gastrocnemius, soleus, popliteus, plantris, abdominals, and the quadratus lumborum.

It is an additional object of the present invention to provide a new and improved footwear exercising device for use in improving the posture of a wearer.

It is an additional object of the present invention to provide a new and improved footwear exercising device for use in improving the circulation in the legs of a wearer.

It is an additional object of the present invention to provide a new and improved footwear exercising device for use in strengthening the natural knee support of a wearer.

It is a further object of the present invention to provide a new and improved footwear exercising device which can be worn for extremely long periods of time without producing a fatigue on the wearer.

It is a further object of the present invention to provide a new and improved footwear exercising device which can be worn with a wide variety of fashion.

It is another object of the present invention to provide a new and improved footwear exercising device which may be easily and efficiently manufactured, marketed and installed.

It is still a further object of the present invention to provide a new and improved footwear exercising device which is of durable and reliable construction.

It is yet still a further object of the present invention to provide a new and improved footwear exercising device which meets all federal, state, local and other private standards, guidelines, regulations and recommendations with respect to safety, environmental friendliness, energy conservation, etc.

An even further object of the present invention is to provide a new and improved footwear exercising device which is susceptible of a low cost of manufacture with regard to both materials and labor, and which accordingly is then susceptible of low prices of sale to the consuming public, thereby making such an exercising device economically available to the buying public.

These together with other objects of the invention, along with the various features of novelty which characterize the footwear exercising device of the present invention, are pointed out with particularity in the claims appended hereto and forming part of this disclosure. The more important objects of the present invention have been outlined rather broadly in order that the detailed description thereof which follows may be better understood, and in order that the present contribution to the art may be better appreciated. For a better understanding of the instant invention, its operational advantages and the specific objects attained by its uses, reference should be made to the accompanying drawings and descriptive matter in which there are illustrated various embodiments of the invention.

Those versed in the art will readily ascertain, however, that the invention is capable of other embodiments and of being practiced and carried out in various other ways. In this respect, the details of construction disclosed herein, and the arrangements of the components set forth in the following description and appended drawings are for illustrative purposes, only, and are not intended to be limiting in scope. Those skilled in the art will appreciate, as well, that the conception upon which this disclosure is based, may be readily utilized as a basis for the designing of other structures, methods, and systems for carrying out the several purposes of the present invention. Said other structures may include, but are not limited to, those which are aesthetic in nature, or those which include the substitution of other materials as they become available, and which substantially perform the same function in substantially the same manner with substantially the same result as the present invention. It is important, therefore, that the claims appended hereto be regarded as including such equivalent structures, constructions, methods, and systems insofar as these do not depart from the spirit and scope of the present invention.

BRIEF DESCRIPTION OF THE DRAWINGS

The invention will be better understood and objects other than those set forth above will become apparent when consideration is given to the following detailed description. Such description makes reference to the appended drawings, wherein.

DETAILED DESCRIPTION OF THE INVENTION

The present invention comprises an improved footwear exercising device for use by a wearer in improving various aspects of the wearer's physical condition, health and overall appearance. Prolonged use of the device of the present invention has been shown to improve the condition and tone of the muscle groups of a wearer's body which have to do with the wearer's posture, including the following: gluteus maximus, gluteus medius, gluteus minimus, tensor fasciae latae, pyriformis, gemellus superior, obturator internus quadratus femoris, psoas major, illiacus, rectus femoris, vastus medialis, vastus intermedius, vastus lateralis, biceps femoris, semitendinosus, semimembranosus, gastrocnemius, soleus, popliteus, plantris, abdominals, and the quadratus lumborum. Such muscle group improvement has included a substantial reduction of the size of a wearer's waist and thigh measurements. Prolonged use of the instant invention has been shown to further improve the blood circulation in a wearer's legs, as demonstrated by the color of varicose veins turning from a natural color of deep purple to a natural color of light pink. Prolonged use of the instant invention has been still further shown to strengthen significantly the muscles supporting the wearer's knees, especially the medial and lateral heads of the gastrocnemius and the plantaris. Perhaps the most interesting note concerning the achievement of the noted physical changes via using the instant invention is that prolonged wear of the invention in order to achieve such desirable results is neither strenuous nor taxing. Indeed, the inventor has found that the footwear exercising device of the present invention may be easily worn throughout all the activity of a normal day.

The instant invention comprises a reverse wedge for wear below the sole of a wearer's foot and means for adjoining the wedge to a wearer's foot. The wedge includes a substantially planular upper surface, a lower surface, a forward peripheral edge, two side peripheral edges, and a rear peripheral edge. The wedge further increases in thickness forwardly from the rear peripheral edge toward the forward peripheral edge. Various embodiments of the invention are illustrated in the appended drawings and described in greater detail, below. (All like numerical designations in the figures represent the same or similar elements.)

Figure 1:
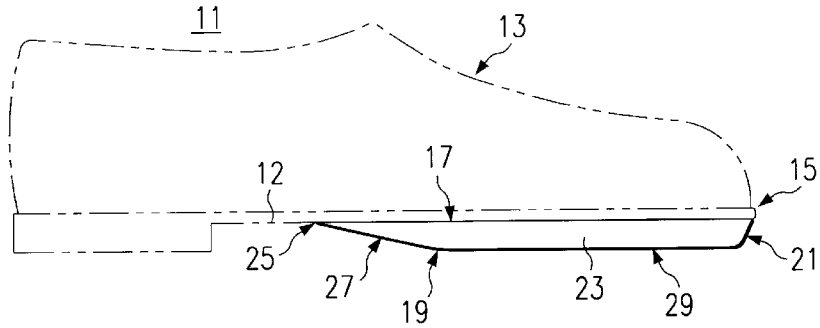
FIG. 1 is a side elevational view of an embodiment of a footwear exercising device according to the present invention affixed to the lower surface of an item of footwear (in phantom)
Figure 2:
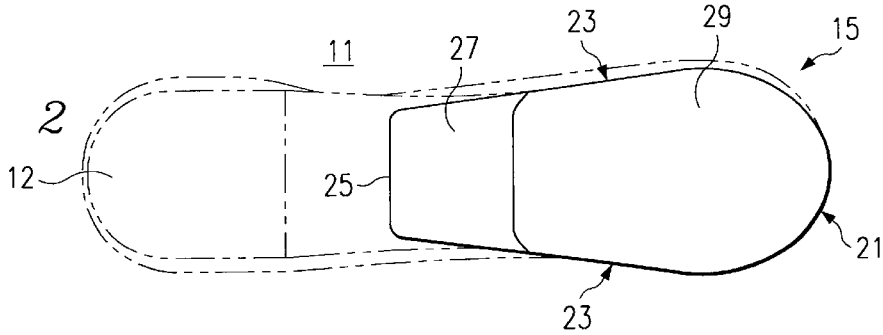
FIG. 2 is a bottom elevational view of the embodiment of a footwear exercising device of FIG. 1.

FIGS. 1 and 2 illustrate an embodiment of a footwear exercising device 11 according to the present invention, affixed to a lower surface of a sole 12 of a shoe 13. Included in the device 11 is a reverse wedge 15 for wear below the sole 12, between a location which underlies the wearer's toes and a location which underlies the sole 12 between the ball of the wearer's foot and the wearer's heel. The wedge 15 further has a substantially planular upper surface 17, a lower surface 19, a forward peripheral edge 21, two side peripheral edges 23, and a rear peripheral edge 25. The lower surface 19 is further divided into a rear plane 27 and a forward plane 29. The wedge 15 increases in thickness forwardly from the rear peripheral edge 25 to where the rear plane 27 meets the forward plane 29, and remains substantially the same thickness from this location to the forward peripheral edge 21. The device 11 is affixed to the sole 12 via an adhesive of the type which is known, placed between the wedge upper surface 17 and a lower surface of the sole 12. However, those skilled in the art will recognize that other affixing means may be used, such as, for example, stitching.

It is preferred that the device 11 is firm, yet flexible, for allowing the sole 12 to bend through its normal movement while the wearer is walking. It is still further preferred that the device 11 provide a small amount of cushion as may be desirable. Those skilled in the art will recognize a wide variety of materials out of which the device 11 may be manufactured, including various synthetic and natural rubbers and leather. In reviewing the inclosed drawings, the reader should note that it is preferable that the greatest of the reverse wedge 15 be greater than that of any heel, if any, which is part of the shoe 13, in order to give the wearer the therapeutic benefit of positioning the lower surface plane of the wearer's foot in substantially an inclined plane which increases from heel to toe, such that the heel can be placed in a closer relation to a walking surface than the toe.

Figure 3:
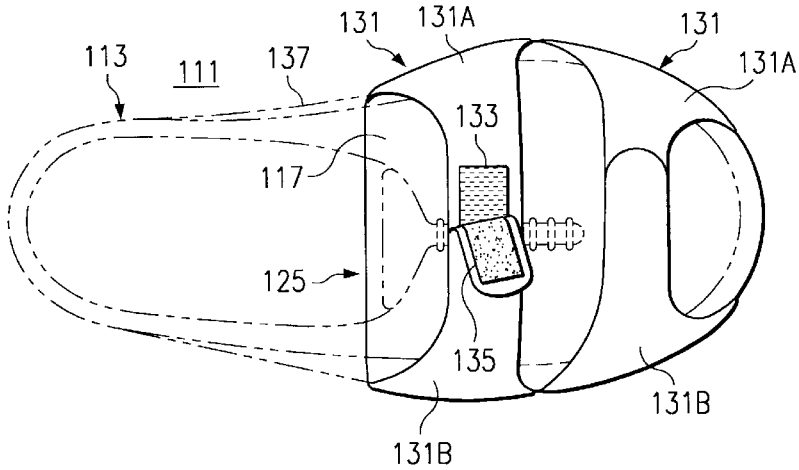
FIG. 3 is a top elevational view of another embodiment of a footwear exercising device according to the present invention, wherein the exercising device is detachably affixed to an item of footwear (in phantom)
Figure 4:
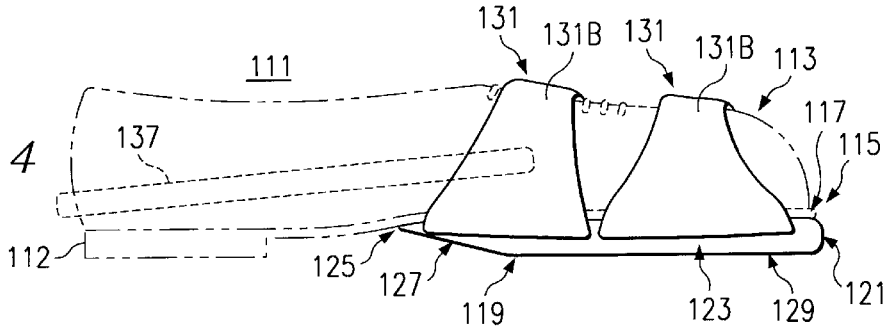
FIG. 4 is a side elevational view of the footwear exercising device of FIG. 4.

FIGS. 3 and 4 illustrate another embodiment of a footwear exercising device 111 according to the present invention, which is substantially similar to the device 11. Like the device 11, the device 111 is affixed to a shoe 113. Shoe 113 may have a neutral heel or positive heel design. However, the means of affixing the device 111 to the shoe 113 is temporary, so that the device 111 may be detached from the shoe 113 and replaced when desirable. Such detachable affixing is accomplished via a pair of forward straps 131 connected at each of two ends to opposite wedge side peripheral edges 123. Each of the straps 131 is further divided into two strap halves 131A and 131B. Each of the strap halves 131A and 131B is further releasably connectable at one of two ends to the other strap half via corresponding strips of hook and loop fastener means 133 and 135, which are affixed to opposing exterior surfaces of the strap halves 131A and 131B via means which are well known. An optional rearward strap 137 (in phantom) may be further provided for helping keep the device 111 in firm position about the shoe 113. The rearward strap 137 is connected at each of two ends to the rear-most strap 131, and may also be divided into two adjoining halves. It is preferred that the length of the strap 137 is adjustable via either adjustable affixing means between either one end of the strap 137 and the rearmost strap 131, or between the two strap 137 halves should the strap 137 be divided in two. The straps 131 and 137 may be made of a wide variety of material.

Further included in the device 111 is a reverse wedge 115 for wear below the shoe sole 112. The wedge 115 has a substantially planular upper surface 117, a lower surface 119, a forward peripheral edge 121, two side peripheral edges 123, and a rear peripheral edge 125. The lower surface 119 is further divided into a rear plane 127 and a forward plane 129. The wedge 115 increases in thickness forwardly from the rear peripheral edge 125 to where the rear plane 127 meets the forward plane 129, and continues at a substantially constant thickness toward the forward peripheral edge 121. Device 111 is designed to provide a negative heel position capability despite the use of a neutral heel or positive heel shoe 113.

Figure 5:
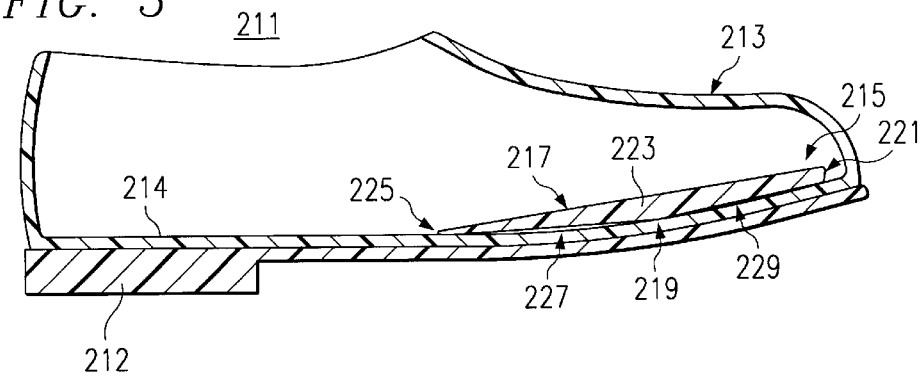
FIG. 5 is a length-wise section view of yet another embodiment of a footwear exercising device according to the present invention, wherein the exercising device is detachably adjoined between the sole of a wearer's foot and an insole of an item of footwear (in phantom)

In FIG. 5 is illustrated yet another embodiment of a footwear exercising device 211 according to the present invention, which includes a reverse wedge 215 for wear inside a wearer's shoe 213. The device 211 is designed for easy insertion inside the shoe 213 so that it may be worn between the lower surface of a wearer's foot and an insole 214 of the shoe 213. Means for adjoining the device 211 to a desirable position below the wearer's foot is a combination of downward pressure applied from the wearer's foot and friction between the upper surface of the shoe insole 214 and a lower surface 219 of the device 211. However, those skilled in the art will recognize that other adjoining means may be used, such as the addition of corresponding hook and loop fastener means between the lower surface 219 of the wedge 215 and the insole 214 upper surface. Further included in the wedge 215 is a substantially planular upper surface 217, a forward peripheral edge 221, two side peripheral edges 223, and a rear peripheral edge 225. The lower surface 219 is further divided into a rear plane 227 and a forward plane 229. The wedge 215 increases in thickness forwardly from the rear peripheral edge 225 to where the rear plane 227 meets the forward plane 229, and from which location the thickness of the wedge 215 remains substantially constant to the forward peripheral edge 221. The shape of the wedge 215 periphery is substantially similar to that of the wedge 15 (see FIG. 2), such that it covers substantially the lower surface of the wearer's foot. It is preferred that the wedge 215 is made of a firm yet flexible material such as a natural or synthetic rubber or leather, although a wide variety of other materials may be used. Wedge 215 is designed to provide a negative heel capability despite the use of a neutral heel or positive heel shoe 213. Though shoe 213 is shown with a heel, reverse wedge 215 preferably is placed in a shoe with a neutral heel where the heel and toes of a wearer's foot are in a substantially planar position.

Figure 6:
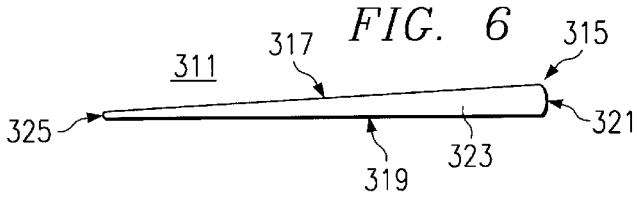
FIG. 6 is a side elevational view of yet still another embodiment of a footwear exercising device according to the present invention which is substantially similar in use to the embodiment of FIG. 5.

FIG. 6 illustrates another embodiment of a footwear exercising device 311 according to the present invention, which device is substantially similar to the device 211, except in the shape of the lower surface. The device 311 comprises a reverse wedge 315, which further includes a substantially planular upper surface 317, a lower surface 319, a forward peripheral edge 321, two side peripheral edges 323, and a rear peripheral edge 325. Unlike the device 211, the lower surface 319 is not divided into rear and forward planes. The wedge 315 increases in thickness forwardly from the rear peripheral edge 325 to the forward peripheral edge 321. The shape of the wedge 315 periphery is substantially similar to that of the wedge 215, is further made of similar material and is adjoined to a wearer's foot in substantially similar fashion.

Figure 7:
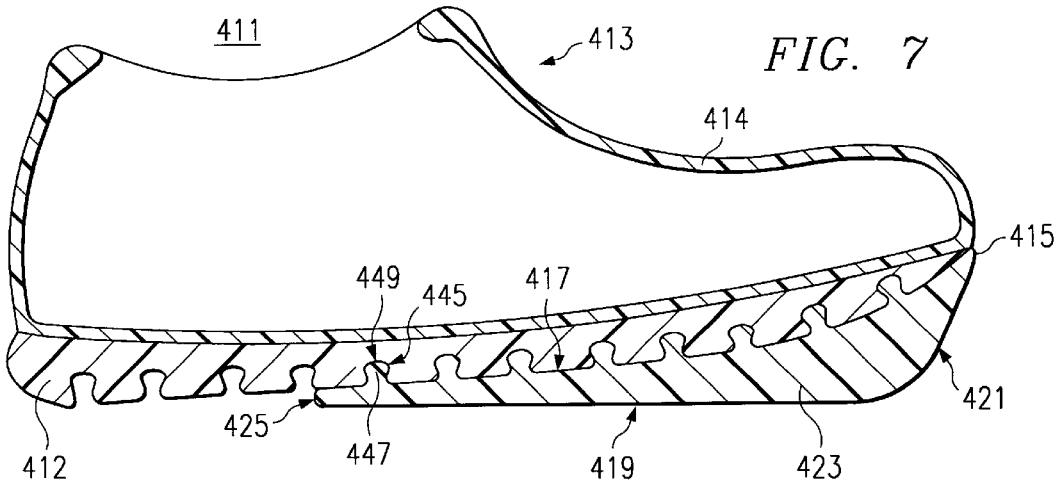
FIG. 7 is a length-wise section view of yet another embodiment of a footwear exercising device according to the present invention, wherein the exercising device is detachably affixed to a lower surface of a sole of an item of footwear (in phantom)

In FIG. 7 is illustrated yet another embodiment of a footwear exercising device 411 according to the present invention, which is designed as part of an exercise shoe 413. The device 411 comprises a reverse wedge 415, which further includes a substantially planar upper surface 417, a lower surface 419, a forward peripheral edge 421, two side peripheral edges 423, and a rear peripheral edge 425. Similar to the lower surface 319 of the device 311, the lower surface 419 is not divided into rear and forward planes. The wedge 415 increases in thickness forwardly from the rear peripheral edge 425 to the forward peripheral edge 421. The preferred shape of the wedge 415 periphery is substantially similar to that of the wedge 15. Further included in the device 411 is means for detachably affixing the wedge 415 to the lower surface of a sole 412 of the shoe 413. Said affixing means comprises male-to-female interlocking fastener means 445 formed as part of the wedge upper surface 417 and the sole 412 lower surface for detachable connection. The interlocking connection means 445 include a plurality of elongate male projections 447 and corresponding elongate female open sided conduits 449, although those skilled in the art will recognize that a wide variety of interlocking connection means 445 may be utilized as part of the device 411. It is preferred that such interlocking connecting means be of a form from which debris may be easily cleaned for ready and secure connection between the wedge 415 and the sole 412, such as is the case with the female open sided conduits 449. Further included in the device 411 is means for adjoining the exercising device to a wearer's foot, comprising a shoe upper. 414 affixed to the sole 412 upper surface substantially adjacent to the sole peripheral edge (not shown) via means which are known.

A significant advantage afforded with the device 411 is that a variety of exercises are obtainable through wearing the device. As well as allowing a wearer the opportunity to exercise the muscles associated with good posture and knee support through use of the wedge 415, the device 411 further affords the wearer opportunity to use the same shoe 413 in performing other exercises which are more rigorous than that in which the wearer may desire to include wear of the wedge. Also, athletes desiring to include wearing the wedge 415 throughout a more extensive work-out, have the option of removing the wedge 415 at anytime, without having to change shoes.

Figure 8:
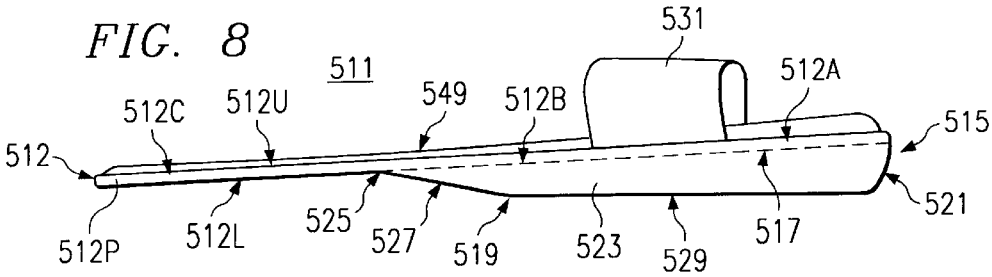
FIG. 8 is a side elevational view of still another embodiment of a footwear exercising device according to the present invention.

In FIG. 8 is illustrated yet another embodiment of a footwear exercising device 511 according to the present invention, wherein means for adjoining the device to a wearer's foot includes a forward strap 531 in which may be inserted the forward portion of a wearer's foot. In this fashion, the device 511 is similar in appearance to a sandal for casual wear. The device 511 further includes a sole 512 having a front portion 512A for underlying a wearer's toes and ball of a wearer's foot, a middle portion 512B for underlying a wearer's arch behind the ball of a wearer's foot and forward of a wearer's heel, and a rear portion 512C for underlying a wearer's heel. The sole 512 further comprises a sole upper surface 512U for supporting the lower surface of a wearer's foot, a sole lower surface 512L oppositely disposed in relation to the sole upper surface 512U and in a plane which is substantially parallel to the sole upper surface 512U, and a sole peripheral edge 512P. The sole upper surface 512U may include further form for providing additional comfort to a wearer, such as a slight rise substantially below a wearer's arch, or a slight depression substantially below a wearer's heel.

Further included in the device 511 is a reverse wedge 515 having a wedge upper surface 517, a wedge lower surface 519, a wedge forward peripheral edge 521, two wedge side peripheral edges 523, and a wedge rear edge 525. The wedge upper surface 517 is substantially planular and affixed to the sole lower surface 512L such that said upper surface 517 extends between a forward portion of the sole peripheral edge 512P and a location on the sole middle portion 512B. The sole 512 and wedge 515 are affixed together via means which are known. However, it is preferred that the sole 512 and the wedge 515 be manufactured as a unitary piece, via, for example, injection molding. Similar to devices 11, 111 and 211, the lower surface 519 of the wedge 515 is divided into a rear plane 527 and a forward plane 529. The wedge 515 likewise increases in thickness forwardly from the wedge rear edge 525 to a location at which the rear plane 527 and forward plane 529 meet, and increases at a lesser angle from said location toward the wedge forward peripheral edge 521. A padded insole 549 is affixed to the sole upper surface 512U for providing additional comfort to a wearer. The insole 549 may be made of a wide variety of materials and material combinations, such as, for example, a leather upper surface and a cushioned neoprene lower lining. It is preferred that the strap 531 is connected at each of two ends to opposite side peripheral edges 512P via means which are known, but may also be affixed between a lower surface of the insole 549 and the sole upper surface 512U, or to the wedge side peripheral edges 523. It is further preferred that the strap 531 comprise an elastic material for adjusting to a variety of feet shapes, although a wide variety of other strap materials and adjustment means which are known may likewise be used in conjunction with the device 511.

Figure 9:
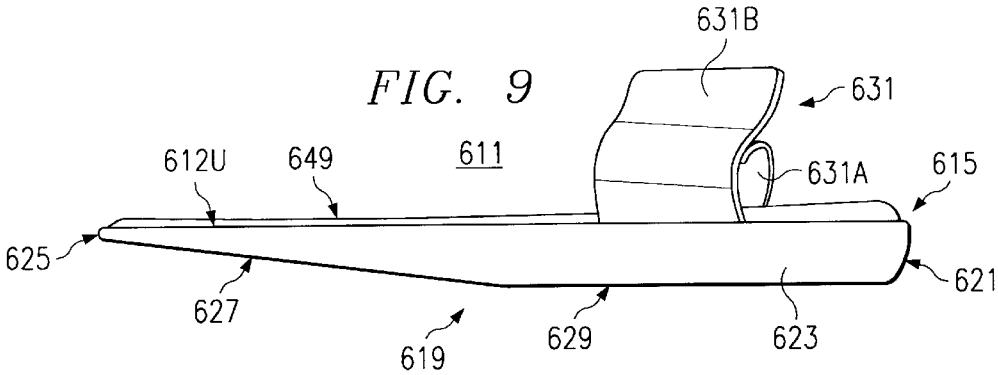
FIG. 9 is a side elevational view of yet another embodiment of a footwear exercising device according to the present invention.

In FIG. 9 is illustrated yet another embodiment of a footwear exercising device 611 according to the present invention, which is similar to the device 511 in that it has a sandal-like appearance and includes a forward strap 631 for adjoining the device 611 to a wearer's foot. The device 611 further includes a combination reverse wedge and sole 615 for wear below the sole of a wearer's foot. The combination 615 further has a substantially planular upper surface 612U for supporting the lower surface of a wearer's foot and a lower surface 619 oppositely disposed to the upper surface 612U. The combination 615 further comprises a forward peripheral edge 621, two side peripheral edges 623, and a rear peripheral edge 625. Like the sole upper surface 512U of the device 511, the combination upper surface 612U may include further form for providing additional comfort to a wearer, such as a slight rise substantially below a wearer's arch, or a slight depression substantially below a wearer's heel. Unlike the combined lower surfaces of the device 511, the combination lower surface 619 is divided substantially into a forward plane 629 which is substantially similar in length to the forward plane 529 of the device 511, and a rear plane 627 which extends rearward from where it is joined to the forward plane 629 to the rear peripheral edge 625. The combination 615 further has a thickness which increases forwardly from the rear peripheral edge 625 to where the rear plane 627 and the forward plane 629 meet. It is preferred that the thickness of the combination 615 remain constant from said location to the forward peripheral edge 621. A padded insole 649 substantially similar to the insole 549 of device 511 is still further provided. The forward strap 631 is divided into two strap halves 631A and 631B. Each of the strap halves 631A and 631B is further releasably connectable at one of two ends to the other strap half via means which are known, such as corresponding strips of hook and loop fastener means, buckles, snaps, or the like. Each of the strap halves 631A and 631B is also connected at opposite ends to the device 611 in similar fashion to that used to connect the opposite ends of strap 531 to the device 511.

Figure 10:
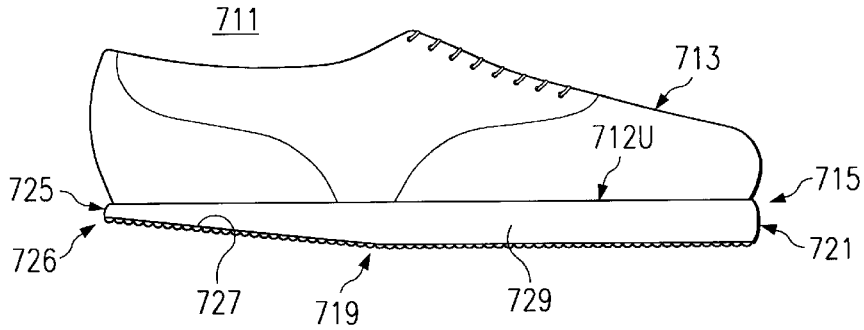
FIG. 10 is a side elevational view of yet still another embodiment of a footwear exercising device according to the present invention.

After reviewing the devices 511 and 611, it will be apparent to those skilled in the art that the soles 512 and 612 may also be independently adjoined to the foot of a wearer via affixing the upper surfaces, 512U and 612U, of said soles to a wide variety of shoe uppers, rather than via use of the straps 531 and 631. An example of this is illustrated in FIG. 10, in which is provided still yet another embodiment of a footwear exercising device 711 according to the present invention. The device 711 includes a combination reverse wedge and sole 715 which is substantially similar to that of the combination 615 of the device 611, for wear below the sole of a wearer's foot. The combination 715 is affixed to a shoe upper 713 via means which are known. The combination 715 further has a substantially planular upper surface 712U for supporting the lower surface of a wearer's foot and a lower surface 719 oppositely disposed to the upper surface 712U. Similar to the upper surface 612U of the device 611, the upper surface 712U may include further form or a cushioned insole for providing additional comfort to a wearer. The lower surface 719 is divided into at least a rear plane 727 and a forward plane 729, and also includes a treaded design 726 along its entire length and width. The combination 715 further comprises a forward peripheral edge 721, two side peripheral edges 723, and a rear peripheral edge 725.

The combination reverse wedge and sole 715 may be designed such that there are different thicknesses where the rear plane 727 and the forward plane 729 meet. Also, rear plane 727 and the forward plane 729 meet. Also, rear plane 727 and forward plane 729 may be separated by a cavity or recess such that they do not meet at lower surface 719. Further, though a wearer's foot is contemplated to be directly supported by upper surface 712U, there may be one or more midsoles separating a wearer's foot from upper surface 712U to provide additional cushioning. Preferably, the midsoles would have substantially planar surfaces in order to provide the benefits of the negative heel configuration of shoe 711.

The footwear exercising device of the present invention was designed to be worn comfortably throughout the activities of a normal day, for providing a level of exercise to the muscles of a wearer's body which control a person's posture. The need for such benefit is well known in a society where a growing portion of the population spends a large portion of each day sitting (as opposed to standing or walking). Added benefits of using the footwear exercising device of the present invention include improved circulation in the legs and significantly improved strength in the muscles which support the knee. It will be obvious to those skilled in the art that the styles of footwear with which the device of the present invention may be worn are virtually limitless, including dress and formal wear shoes, work shoes and boots, casual shoes, deck shoes, sandals, house slippers, golf shoes, hiking shoes and boots, riding boots, tennis shoes, moccasins, jogging and running shoes, espadrilles, ice skates, in-line skates, etc. Use of the present invention is particularly advantageous with ski-boots, not only in that it strengthens muscles which support the knees, but in that it allows a skier to apply more forward pressure against the skies than he or she would be allowed to apply via normal ski boots. When these numerous advantages are added to the fact that the exercising device of the present invention is also comfortable to wear and is not taxing on the wearer, those skilled in the art will readily recognize the unique advantages the present invention makes available to the consuming public.

Figure 11A:
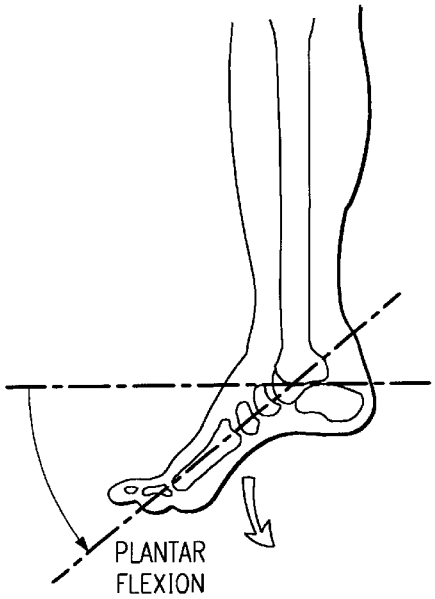
FIGS. 11A–11B illustrate different skeletal positions of a wearer's ankle.
Figure 11B:
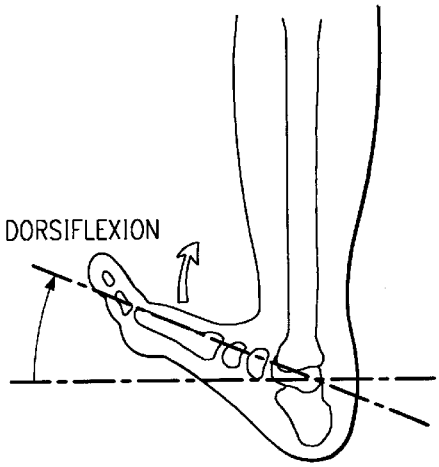

FIGS. 11A–11B show two different skeletal positions of the ankle. In FIG. 11A, the ankle is shown in a positive heel, or plantar flexion, position. In FIG. 11B, the ankle is shown in a negative heel, or dorsiflexion, position. For shoes in a positive heel position, the higher the heel in the shoe the more forward pelvic tilt that occurs in the wearer. Heel height in shoes has a strong relationship to lower back and neck pain. Further, depending on the height of the heel, shoes can double the amount of pressure on the ball of the foot and shove the toes into a v-shaped wedge. This results in such afflictions as bunions, corns, callouses, Morton's neuroma, and hammertoes.

Figure 12:
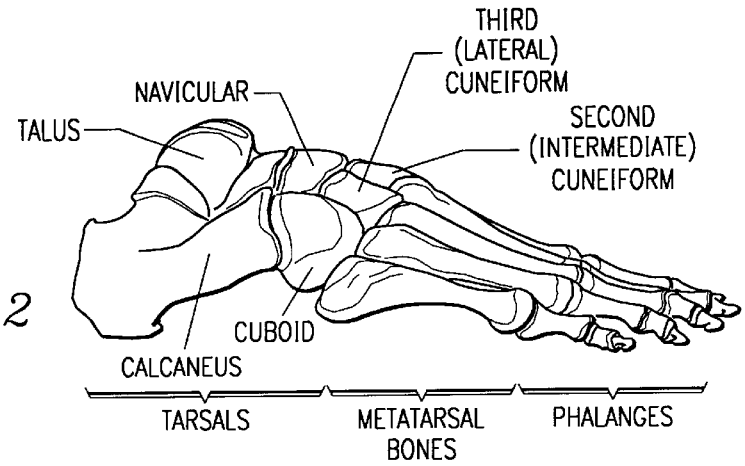
FIG. 12 illustrates a skeletal bone structure for a foot.

FIG. 12 shows the bone structure of a foot. Most shoes are designed in the plantar flexion or positive heel position which has the heel higher than the toes relative to the ground. The positive heel position structurally splits the weight among the tarsal, metatarsal, and phalanges of the foot. The metatarsal and phalanges, being much smaller bones, are not designed to carry excess body weight. For higher heel shoes, most of a wearer's body weight is placed on the phalanges which are the smallest and most delicate bones of the foot, creating many of the afflictions mentioned above.

Shoes that place the foot in a negative heel position as in the present invention, where the heel is closer to the ground relative to the toes, helps to place the skeletal structure of the body in a better alignment than positive heel shoes. In the dorsiflexion or negative heel position, body weight is transferred from the tibia and fibula bones directly to the calcaneus bone. The calcaneus bone is the largest and strongest of the tarsal bones and is designed to transmit the weight of the body to the ground. Walking or running in a shoe having a negative heel position allows the foot to properly absorb the shock of ground contact and reduce the amount of shock on the lower back. The negative heel position also eliminates or reduces forward pelvic tilt that can affect the curve of the back and cause pelvic muscles to lose tone. Further, a negative heel position shoe eliminates or reduces the tendency found in positive heel shoes for the calf, hip, and back muscles to tense up and eventually tire while maintaining balance.

Table 1 shows the energy expenditure between a negative heel and a positive heel shoe. A subject was measured in consecutive trials using one of two pairs of shoes during the following procedure. The negative heel shoes were worn first in the protocol sequence. Any additional energy expenditure from an elevated metabolism would occur during the positive heel trial. Thus, the differences shown are not biased. As can be seen, the negative heel shoe has a higher energy expenditure versus the positive heel shoe.

TABLE 1

| | | VO2 miles/kg/min | | |
|---|---|---|---|---|
| | | Neg | Pos | % Diff |
| Standing: | No difference | 2.3 | 2.3 | 0 |
| Walking | 3.3 mph/0% grade | 11.7 | 10.9 | 7.3 |
| Racewalking | 5.5 mph/0% grade | 26.1 | 22.0 | 18.6 |
| Running | 9.0 mph/0% grade | 36.1 | 30.9 | 16.8 |

Table 2 shows the effects upon weight loss when wearing the negative heel shoe. Due to the increase in energy expenditure of the negative heel shoe, an assumed additional 10% energy expenditure was used though the additional energy expenditure may range from 7% to 18%. As shown, the additional energy expenditure merely from wearing the negative heel shoe for daily activities would burn additional calories that can assist with either fat loss or better weight maintenance.

TABLE 2

| | Effects upon Weight Loss (Fat pounds loss) | | | |
|---|---|---|---|---|
| Cal/day | With Neg. Heel | Cal/wk Add'1 | Wks to 1 lb. loss | Fat lbs/ Year Loss |
| 200 | 220 | 140 | 25 | 2.1 |
| 300 | 330 | 210 | 16.7 | 4.0 |
| 400 | 440 | 280 | 12.5 | 4.2 |
| 500 | 550 | 350 | 10.0 | 5.2 |
| 600 | 660 | 420 | 8.3 | 6.3 |
| 700 | 770 | 490 | 7.1 | 7.3 |
| 800 | 880 | 560 | 6.25 | 8.3 |
| 900 | 990 | 630 | 5.6 | 9.3 |
| 1000 | 1100 | 700 | 5.0 | 10.4 |
| 1100 | 1210 | 770 | 4.5 | 11.6 |
| 1200 | 1320 | 840 | 4.16 | 12.5 |

Figure 13:
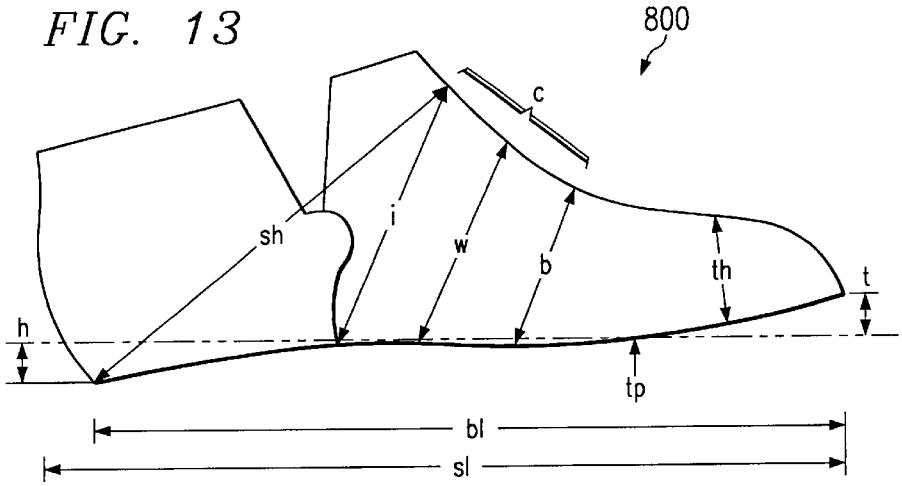
FIG. 13 illustrates a last used in making a shoe according to the present invention.

FIG. 13 shows a last 800 for making negative heel shoes. Last 800 serves to substantially define the internal and external shape, as well as the geometry, of an article of footwear. Last 800 is a foot-shaped form or model over which an article of footwear is formed. The last 800 is designed so that it places the foot in a particular relationship to the lower leg bones. This relationship is preferably at an angle of less than 90° so that the heel is closer to the ground in relation to the toes. This relationship helps keep the foot in nothing more than an acute angle to the lower leg bones while walking, running, or standing or in contact with most trodden surfaces. This last design will be used to develop a shoe that allows the body weight of a wearer to be distributed to the ground through the calcaneus bone as discussed above and provide an alignment of the skeletal structure to alleviate knee and back pain and improve muscle tone and cardiovascular efficiency. Last 800 is capable of making the shoe 711 of FIG. 10 with a substantially planar upper sole surface and lower sole surface with a constant thickness forward section and a decreasing thickness rear section. Last 800 is typically created by casting in plaster the feet of a number of subjects in a weight bearing condition. From the plaster cast, a shoe manufacturer's model is created. The shoe manufacturer's model is typically made of wood, plastic, or other conventional material and is used in making the actual shoe.

Last 800 generally includes four main parts: the last block, a metal plate covering a portion or all of the sole area, a hinge in the middle of the last which allows the last to be divided for easy removal of the last from the shoe, and a thimble through the top and back part of the last which allows a spindle to be inserted to hold the last during the shoemaking process. Some of the common measurements which are taken into consideration when making a last are shown in FIG. 13. As illustrated, the cone "c" for last 800 is the upper portion extending from the ball portion to the top of the heel portion. The upper surface or top of last 800 is referred to as the cone island "ci". Last 800 may also have an elevation of toe tip that is measured from the tread point "tp" and a toe thickness "th" which defines the space given for the toes of the wearer of the footwear. The elevation of the toe tip is called toe spring "t". The ball or ball girth "b" of last 800 is the greatest dimension around the forefoot area. The bottom of last 800 extends downwardly from the tread point "tp" to define the negative heel height "h". The short heel or short heel girth "sh" of last 800 is the dimension around last 800 passing through the instep and the heel feathering point. The instep or instep girth "i" is the dimension around last 800 passing through the instep point. Similarly, the waist or waist girth "w" is the smallest dimension around last 800 between the ball girth and the instep girth. As shown in FIG. 13, two common measurements for last 800 are the stick length "sl" and the bottom length "bl" which are taken by a measuring instrument called a stick. Further terms of art and measurements known to one of ordinary skill in the art are described in American Lastmaking, by Karl C. Adrian, published in 1991 by the Shoe Trade Publishing Company, of Arlington, Mass., the entire contents of which are hereby incorporated by reference.

The calf muscle is considered the peripheral heart of the vascular system, especially of the lower extremities. If there is venuous congestion or poor venous return, then severe leg fatigue results. Anything that emphasizes contractions of the major calf muscle will increase venous return and decrease leg fatigue. The leg has venous sinuses throughout the calf muscle that hold blood. Whenever the calf muscle contracts, walking in a shoe made according to the present invention, more of the calf muscle is used than in conventional shoes. Therefore, greater blood flow is created to the heart. Use of the shoe according to the present invention has also provided improvement to the other muscles of the leg including the following: tibialis anterior, extensor hallucis longus, extensor digitorum longus, peroneous tertius, plantaris, gastrocnemius, soleus, flexor hallucis longus, flexor digitorum longus, tibialis posterior, peroneous longus, and peroneous brevis.

Figure 14:
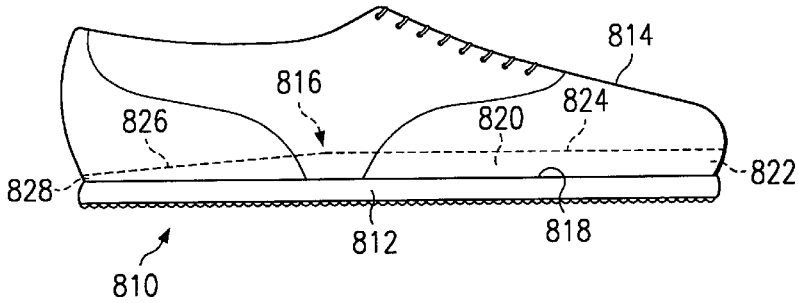
FIG. 14 illustrates an alternate shoe embodiment.

FIG. 14 is an alternate shoe embodiment incorporating features of the present invention. Shoe 810 includes a substantially planar outsole 812 affixed to a shoe upper 814. Shoe 810 includes an insole 816 which preferably lies over a surface 818 of outsole 812 enclosed by shoe upper 814. Insole 816 may be in direct contact with surface 818 of outsole 812 or may be separated therefrom by one or more midsoles. Insole 816 may be permanently affixed to outsole 812 and/or shoe upper 814 or have the capability to be removably inserted into or extracted from shoe 810. Insole 816 includes a first portion 820 of substantially constant thickness that extends rearward from a forward periphery 822 of outsole 812 and shoe upper 814 to a point 824 approximately halfway across a length of shoe 810. Insole 816 includes a second portion 826 that extends forwardly from a rear periphery 828 of outsole 812 and shoe upper 814 to meet the first portion 820 at point 824. Second portion 826 has an increasing thickness from rear periphery 828 to point 826. Insole 816 may have similar characteristics discussed with respect to outsole 715 discussed in FIG. 10. Shoe 810 may also be manufactured using last 800.

The inventor has given a non-limiting description of several embodiments of the present invention, to which many changes may be made without deviating from the spirit of the invention. While this invention has been described with reference to several illustrative embodiments, this description is not intended to be construed in a limiting sense. Various modifications and combinations of the various embodiments as well as other embodiments of this invention will be apparent to a person skilled in the art upon reference to this description. It is therefore contemplated that the appended claims cover any such modifications and/or embodiments that fall within the true scope of the present invention.

What is claimed is:

1. A last for defining a shape of a shoe, comprising:

a forefoot portion;

a cone portion rearward of the forefoot portion;

a heel portion rearward of the cone portion;

wherein the heel portion, the cone portion, and the forefoot portion place the last in a dorsiflexion position.

2. The last of claim 1, wherein an acute angle is formed between the forefoot portion and a plane extending orthogonally from the heel portion.

3. The last of claim 1, wherein the forefoot portion, the cone portion, and the heel portion are made of a material selected from the group consisting of plastic and wood.

* * * * *